US008324876B1

(12) United States Patent
Le et al.

(10) Patent No.: US 8,324,876 B1
(45) Date of Patent: Dec. 4, 2012

(54) UNCONDITIONAL FREQUENCY COMPENSATION TECHNIQUE ON-CHIP LOW DROPOUT VOLTAGE REGULATOR

(75) Inventors: Thien Le, San Jose, CA (US); Ping-Chen Liu, Fremont, CA (US)

(73) Assignee: Altera Corporation, San Jose, CA (US)

( * ) Notice: Subject to any disclaimer, the term of this patent is extended or adjusted under 35 U.S.C. 154(b) by 843 days.

(21) Appl. No.: 12/263,251

(22) Filed: Oct. 31, 2008

(51) Int. Cl.
*G05F 1/00* (2006.01)

(52) U.S. Cl. ..... 323/273; 323/260

(58) Field of Classification Search ..... 323/273–281, 323/266–270
See application file for complete search history.

(56) References Cited

U.S. PATENT DOCUMENTS 6,229,289 B1 * 5/2001 Piovaccari et al. ..... 323/268
7,589,507 B2 * 9/2009 Mandal ..... 323/273
2002/0130646 A1 * 9/2002 Zadeh et al. ..... 323/275
2005/0088153 A1 * 4/2005 Suzuki ..... 323/274
* cited by examiner

*Primary Examiner* — Jue Zhang
(74) *Attorney, Agent, or Firm* — Womble Carlyle Sandridge & Rice, LLP

(57) ABSTRACT

A low dropout (LDO) voltage regulator with unconditional frequency compensation is presented. The low dropout voltage regulator is implemented using a two-stage operational amplifier. The first stage amplifier has two input transistors, each of which is connected to a diode-connected transistor. A transistor is connected in parallel to the diode-connected transistors to increase the gain of the first stage amplifier. The LDO voltage regulator has a compensation capacitance input between the first stage amplifier and the second stage amplifier and a voltage on the compensation capacitance input adjusts the current through the diode-connected transistors, as well as the gain of the first stage amplifier. The second stage amplifier receives output from the first stage amplifier, and a compensation capacitor is connected between the compensation capacitance input of the operational amplifier and the output node of the LDO voltage regulator.

19 Claims, 5 Drawing Sheets

UNCONDITIONAL FREQUENCY COMPENSATION TECHNIQUE ON-CHIP LOW DROPOUT VOLTAGE REGULATOR

BACKGROUND

Voltage regulators are used in applications which require a well controlled voltage. Voltage regulators need to be carefully designed to maintain proper behavior over the frequency range of operation. The presence of poorly located poles in the frequency response of a voltage regulator may lead to unstable operation of the voltage regulator. Conventional voltage regulators with a two-stage operational amplifier (op-amp) achieve stable behavior over the frequency range of interest by using a technique known as "pole splitting". This technique separates the two poles of the op-amp by moving one pole to a lower frequency and the other pole to a higher frequency. The lowest frequency pole is called the dominant pole because it dominates the effect of the higher frequency poles.

Voltage regulators implementing pole splitting compensation place a resistor and a compensation capacitor in series between the first and the second stage of the op-amp to create the dominant pole at the first stage of the op-amp due to Miller capacitance. The higher frequency pole of the voltage regulator is dependent on the output load capacitance, which in turn depends on chip density and transistor capacitance junction loading.

There are two significant drawbacks to this pole splitting compensation technique. To achieve a dominant pole at low enough frequency, a large compensation capacitance is required, which slows down system response time. The second drawback is the output pole location is changing due to changing of capacitance or current load. This leads to difficulty using a single voltage regulator design for a family of circuits where the output capacitance varies between different designs. In this case, a designer has to tune and verify the voltage regulator performance for each design.

It is in this context that embodiments of the invention arise.

SUMMARY

Broadly speaking, the present invention is an unconditional frequency compensation technique for low dropout voltage regulators. It should be appreciated that the present invention can be implemented in numerous ways, including as a method, a system, or a device. Several inventive embodiments of the present invention are described below.

In accordance with one aspect of the invention, a low dropout (LDO) voltage regulator with unconditional frequency compensation is detailed. The low dropout voltage regulator is implemented using a two-stage operational amplifier (op-amp). The first stage amplifier has two inputs connected to the gate of p-type metal oxide semiconductor (PMOS) transistors, the drain of each PMOS transistor is connected to a diode-connected transistor. A transistor is connected in parallel to the diode-connected transistors to increase the gain of the first stage amplifier. The LDO voltage regulator has a compensation capacitance input between the first stage amplifier and the second stage amplifier and a voltage on the compensation capacitance input adjusts the current through the diode-connected transistors, as well as the gain of the first stage and second stage amplifier. A compensation capacitor is connected between the output of the first stage of the operational amplifier and the output node of the LDO voltage regulator.

In accordance with another aspect of the invention, unconditional compensation method for a LDO voltage regulator is provided. The reference voltage input and a feedback voltage input of a first stage amplifier receive a reference voltage and a negative feedback voltage, respectively. The voltage difference between the reference voltage input and the feedback voltage input is converted to voltage gain at the op-amp output. One terminal of the compensation capacitance is located between the first stage amplifier and the second stage amplifier. The other terminal is located at the output of LDO voltage regulator. The output dominant pole of the LDO voltage regulator is moved to a lower frequency when a compensation capacitor is coupled between the output node of the LDO voltage regulator and the compensation capacitance input.

Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings.

DETAILED DESCRIPTION

The following embodiments describe an apparatus and method for an unconditional frequency compensation technique for low dropout (LDO) voltage regulators. It will be obvious, however, to one skilled in the art, that the present invention may be practiced without some or all of these specific details. In other instances, well known process operations have not been described in detail in order not to unnecessarily obscure the present invention.

The frequency response of a LDO voltage regulator can be described by a complex function with poles and zeros. A zero, also known as a root, is the value of a variable of a complex function which the value of the complex function becomes equal to zero. In order for the LDO voltage regulator to have a stable frequency response over wide range of output load capacitance values, the output dominant pole of the LDO voltage regulator should be placed at a low frequency. In addition, it is advantageous to have the frequency compensation technique track the output pole with a zero over a wide range of output load variation. The presence of zeros, to a large degree, will cancel out the effect of poles on the system. Such a frequency compensation technique in the LDO voltage regulator will provide unconditional system stability and maintain fast response time.

In one embodiment of the present invention described below, the unconditional frequency compensation technique is implemented on the LDO voltage regulator on an operational amplifier (op-amp) with selective gain. In addition, a negative feedback compensation capacitor is placed between the output of the LDO voltage regulator and the output of the first stage of the op-amp. In this configuration, the negative feedback compensation capacitor increases the resistive and the capacitive output load, moving the output dominant pole to a low frequency.

Figure 1:
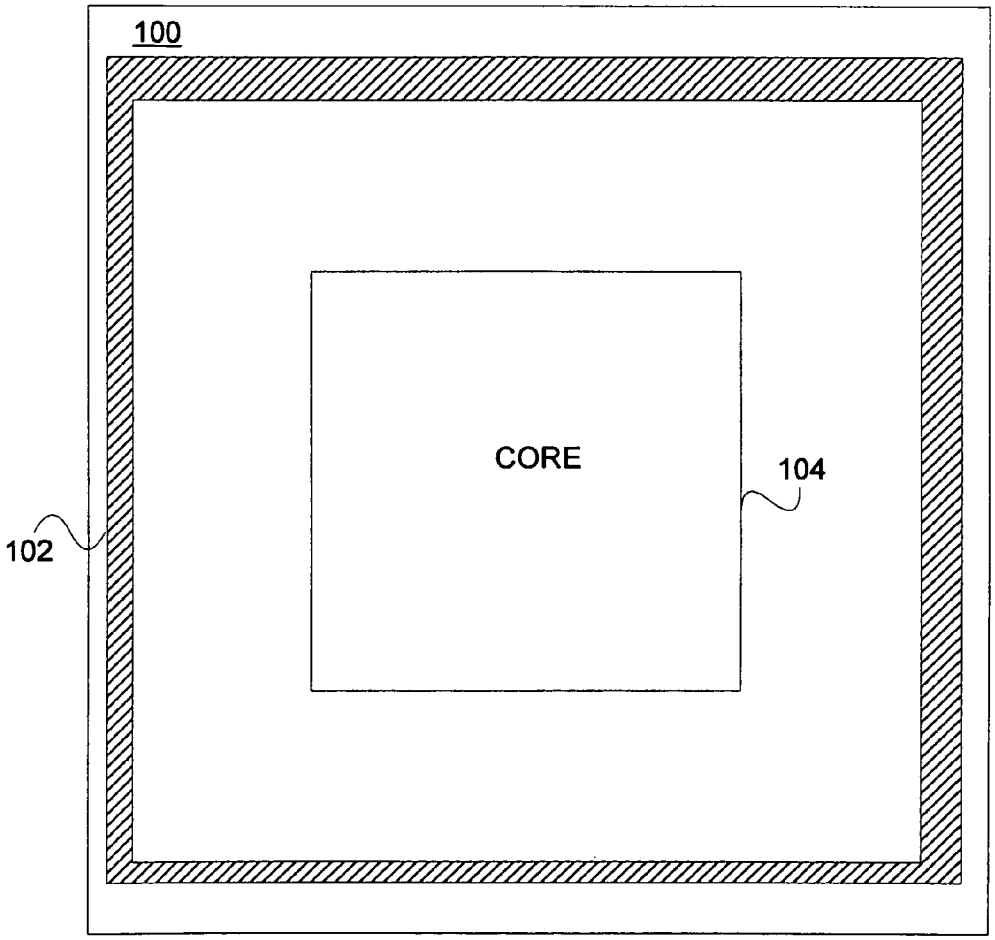
FIG. 1 illustrates a top view of an integrated circuit utilizing a low dropout voltage regulator in the input/output ring in accordance with one embodiment of the present invention.

FIG. 1 illustrates a top view of an integrated circuit utilizing a low dropout voltage regulator in the input/output ring in accordance with one embodiment of the present invention. Low dropout voltage regulators are used in applications which require a well maintained voltage. An integrated circuit 100, such as a processor or an application specific integrated circuit (ASIC), the input/output (I/O) ring 102 contains circuits which operate at a higher voltage than the circuits of the core logic 104. The supply voltage feeding into the I/O ring 102 is stepped down to the voltage required for the core logic 104. This core logic supply voltage is maintained by LDO voltage regulators, in which p-type metal oxide semiconductor (PMOS) passgates are placed around the I/O ring 102 of the integrated circuit 100.

Figure 2:
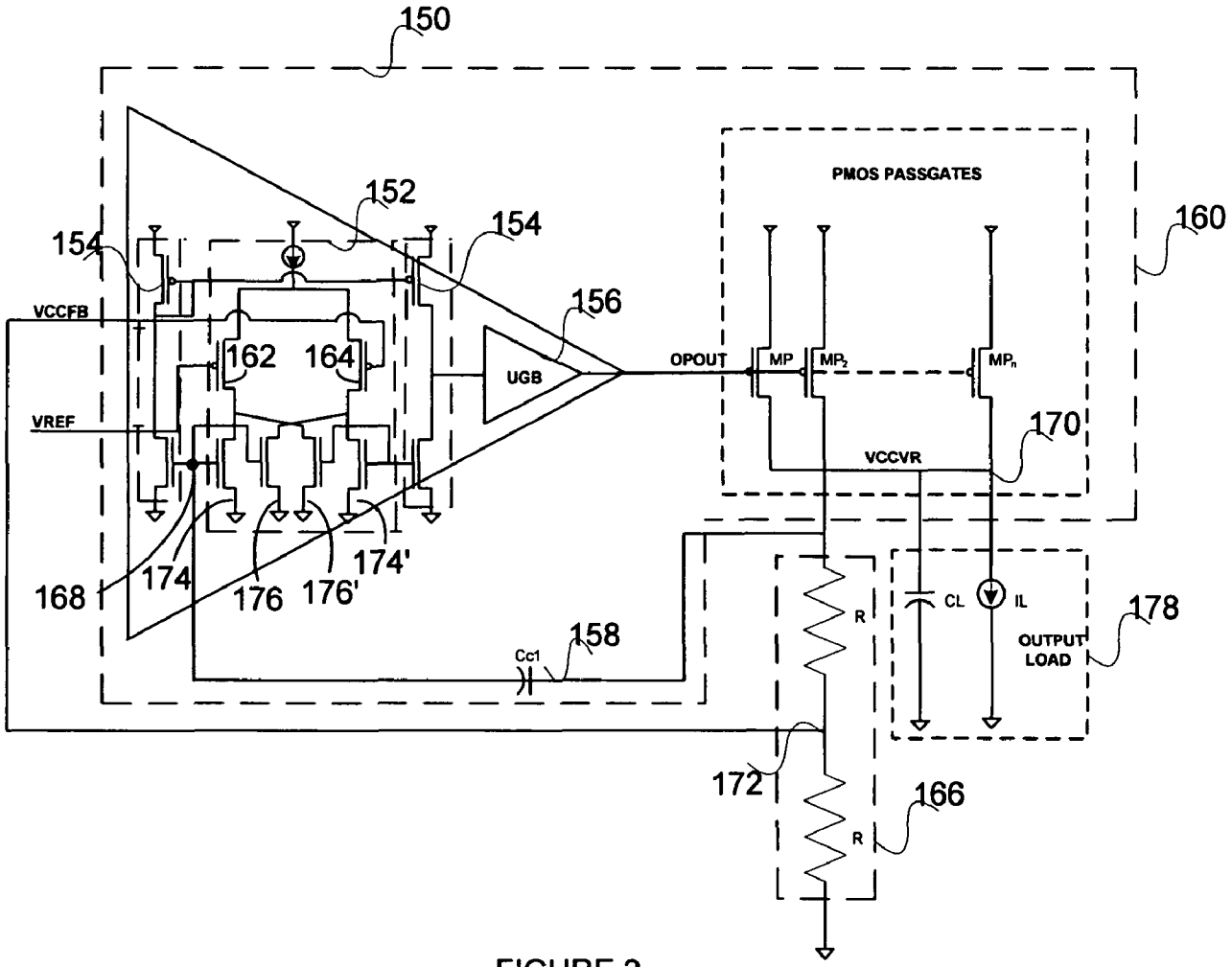
FIG. 2 illustrates a circuit schematic of a LDO voltage regulator implemented with a selective two-stage operational amplifier in accordance with one embodiment of the present invention.

FIG. 2 illustrates a circuit schematic of a LDO voltage regulator implemented with a two-stage operational amplifier in accordance with one embodiment of the present invention. The LDO voltage regulator 150 is implemented using a two-stage operational amplifier. The first stage amplifier 152 of the op-amp has a plurality of input transistors 162 and 164 coupled to a plurality of diode-connected transistors 174. The gate of the first input transistor 162 is connected to the reference voltage. The gate of the second input transistor 164 is connected to the output 170 of the LDO voltage regulator 150 through a voltage divider 166. In one embodiment, a transistor 176 is connected in parallel to each of the diode-connected transistors 174 and 174'. The parallel transistors 176 and 176' increase the direct current (DC) gain of the first stage amplifier 152, if needed. While the diode-connected transistors 174 and 174' have small output resistance and low gain, the parallel transistors 176 & 176 provide higher gain and output resistance to the first stage amplifier 152. The LDO voltage regulator has a compensation capacitance input 168 between the first stage amplifier 152 and the second stage amplifier 154. A compensation capacitor 158 is between the compensation capacitance input 168 of the two-stage operational amplifier and the output node 170 of the LDO voltage regulator 150.

The output voltage (VCCVR) at the output node 170 of the LDO voltage regulator 150 is received at the compensation voltage input 168. The output voltage, VCCVR, at the compensation capacitance input 168 adjusts the gain of opamp first stage 152, as well as second stage gain 154. If the output voltage (VCCVR) increases, the current through the diode-connected transistor 174 increases, which increases the current through the first input transistor 162. The increase in current through the first input transistor 162 increases the gain of the negative feedback first stage amplifier 152.

Still referring to FIG. 2, the second stage amplifier 154 is a high gain amplifier stage. In one embodiment, the second stage amplifier 154 is implemented using a current mirror. In this embodiment, the gain of the second stage amplifier 154 is higher than a gain of the first stage amplifier 154. The LDO voltage regulator 150 has a voltage divider 166 connected to the gate of the second input transistor 164 of the first amplifier stage 152 and the output node 170 of the plurality of PMOS passgates 160. The voltage divider 166 provides a feedback voltage (VCCFB) to the feedback input 172 of the first stage amplifier 152. In one embodiment, the voltage divider 166 consists of a plurality of resistors in series.

A unity gain buffer (UGB) 156 is between an output of the second stage amplifier 154 and the gates of a plurality of PMOS passgates 160 The UGB 156 buffers the output of the second stage amplifier to drive a large gate capacitance of the PMOS passgates 160. The drain of the PMOS passgates 160 is connected to an output load 178. The source of the PMOS passgates 160 is connected to voltage source which is regulated to a lower voltage. The output voltage (OPOUT) is adjusted to keep the output 170 of the LDO voltage regulator 150 at a required reference voltage level regardless of changes of the output load 178 voltage and current.

The voltage difference between the first input 162 and the second input 164 of the first stage amplifier 152 is amplified and corrected to maintain the voltage (VCCVR) at the output node 170 of the LDO voltage regulator 150. If the voltage (VCCFB) at the voltage divider 172 is lower than the reference voltage (VREF), the current of the first input transistor 162 is lower than the current of the second input transistor 164. An increase of current in the second input transistor 164 reduces the voltage to the unity gain buffer 156 and in turn reduces the voltage (OPOUT) on the gate terminal of the PMOS passgates 160. The lower voltage (OPOUT) on the gate of PMOS passgates 160 in turn increases the voltage (VCCVR) on the output node 170 of the LDO voltage regulator 150.

Conversely, if the voltage at the voltage divider (VCCFB) 172 is higher than the reference voltage (VREF), the current of the first input transistor 162 is higher than the current of the second input transistor 164. A decrease of current in the second input transistor 164 increases the voltage to the UGB 156 and in turn increases the voltage (OPOUT) on the gate terminal of the PMOS passgates 160. As a result, the higher voltage (OPOUT) on the PMOS passgates 160 decreases the voltage (VCCVR) on the output node 170 of the LDO voltage regulator 150.

Although a specific transistor configuration was used to illustrate one embodiment of the LDO voltage regulator 150 with a two-stage op-amp, one with skill in the art will appreciate other transistor configurations can be used. That is, so long as the essential elements of a low gain first stage amplifier 152 with low resistance, a second stage amplifier 154 with high gain, and the compensation capacitance 158 connected between the first stage amplifier 152 and second stage amplifier 154, and the output node 170 of the LDO voltage regulator 150 are retained other transistor configurations are possible.

Figure 3B:
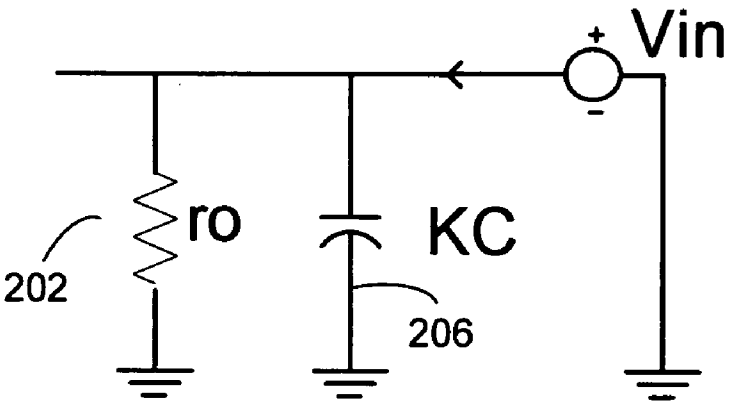
FIG. 3B illustrates a transformation of the small signal equivalent circuit by incorporating the current gain effect on the output load seen by the LDO voltage regulator in accordance with one embodiment of the present invention.
Figure 3A:
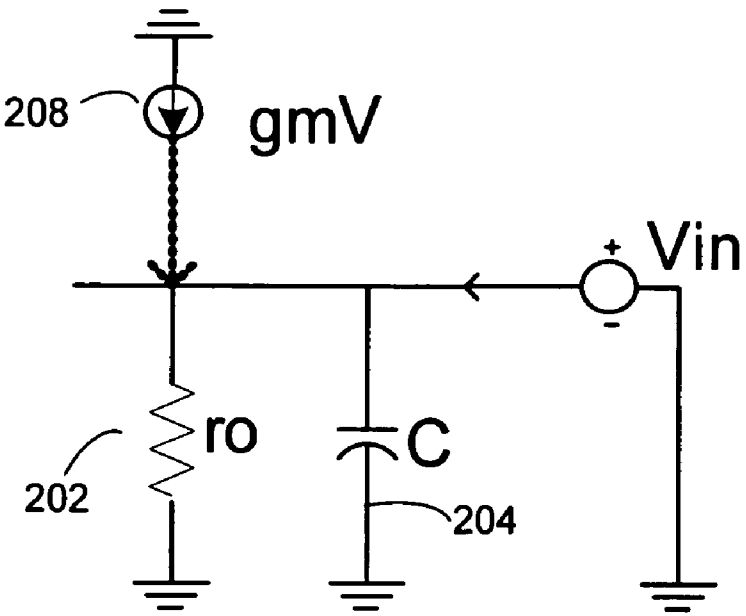
FIG. 3A illustrates a small signal equivalent circuit modeling the current gain of the LDO voltage regulator in accordance with one embodiment of the present invention.

FIG. 3A illustrates small signal equivalent circuit modeling the current gain of the LDO voltage regulator in accordance with one embodiment of the present invention. The small signal equivalent circuit shows output dominant pole is determined by the small signal resistance and capacitance of the output load of the LDO voltage regulator. The output dominant pole can be written as:

$$p = \frac{1}{r_o C} \tag{1}$$

where $r_o$ (202) is a small signal output resistance of the PMOS passgates and an output load capacitance (204). A current gain 208, k, is defined as being proportional to $g_m \times V$ (2).

FIG. 3B illustrates a transformation of the small signal equivalent circuit by incorporating the current gain effect on the output load seen by the LDO voltage regulator in accordance with one embodiment of the present invention. The current gain, k, moves the output dominant pole to a lower frequency by the current gain. The equation for the output dominant pole (1) can then be written as:

$$p = \frac{1}{kr_oC}. \tag{3}$$

And an equivalent capacitance 206, $C_{eq}$, can be defined as:

$$C_{eq}=k\times C \tag{4}.$$

The compensation capacitance $C_{c1}$ affects the current gain and voltage gain of the two-stage operational amplifier. The current gain, k, in (4) can then be written as $A1\times g_m$ (5), where A1 is DC op-amp open loop in and $g_m$ is the output transconductance of the PMOS passgates. The voltage gain from $C_{c1}$ in the negative feedback loop, k', is A1×A2, where A2 is the gain of the PMOS pass-gates. Taking into account the output load capacitance, $C_L$, and the Miller effect on the compensation capacitor, $C_{c1}$, to the equivalent capacitance, the equivalent capacitance in (4) can then be written as:

$$C_{eq}=k\times(k'\times C_{c1}+C_L) \tag{6}$$

where k' α A1×A2.

Using the equivalent capacitance in (6) and the small signal output conductance of the PMOS passgates is gds is $$g_{ds} = \frac{1}{r_o}, \tag{7}$$

is the output dominant pole can be written as:

$$p = \frac{g_{ds}}{k\times(k'\times C_{c1}+C_L)} \tag{8}$$

Analyzing equation (8) for the output dominant pole, one of ordinary skill in the art will note the dominant pole is determined by the small signal conductance of the plurality of PMOS passgates and the compensation capacitance, for high values of the voltage gain, k'. The frequency of the output dominant pole is weakly dependent on the value of the output load capacitance. The compensation capacitance can be relatively small and the output dominant pole located at a low frequency. By designing adequate phase margin for the smallest output $r_o\times C_L$ of the LDO voltage regulator, the LDO voltage regulator will achieve unconditional frequency compensation across large variations of output load capacitance.

Using similar analysis, the frequency of the zero created from compensation capacitance feedback loop of the present invention can be written as:

$$z = \frac{g_{md}}{C_{c1}}, \tag{9}$$

where $g_{md}$ is the transconductance of the diode-connected transistors of the first stage amplifier. The resistance of the diode-connected transistors of the first stage amplifier, $r_d$, can be written as:

$$r_d = \frac{1}{g_{md}}$$

and the value of rd is very small compared to the conductance of the transistors that are not diode-connected. This indicates the zero is located at high frequency and determined by the resistance of the plurality of diode-connected transistors of the first stage amplifier and the compensation capacitor capacitance.

Figure 4:
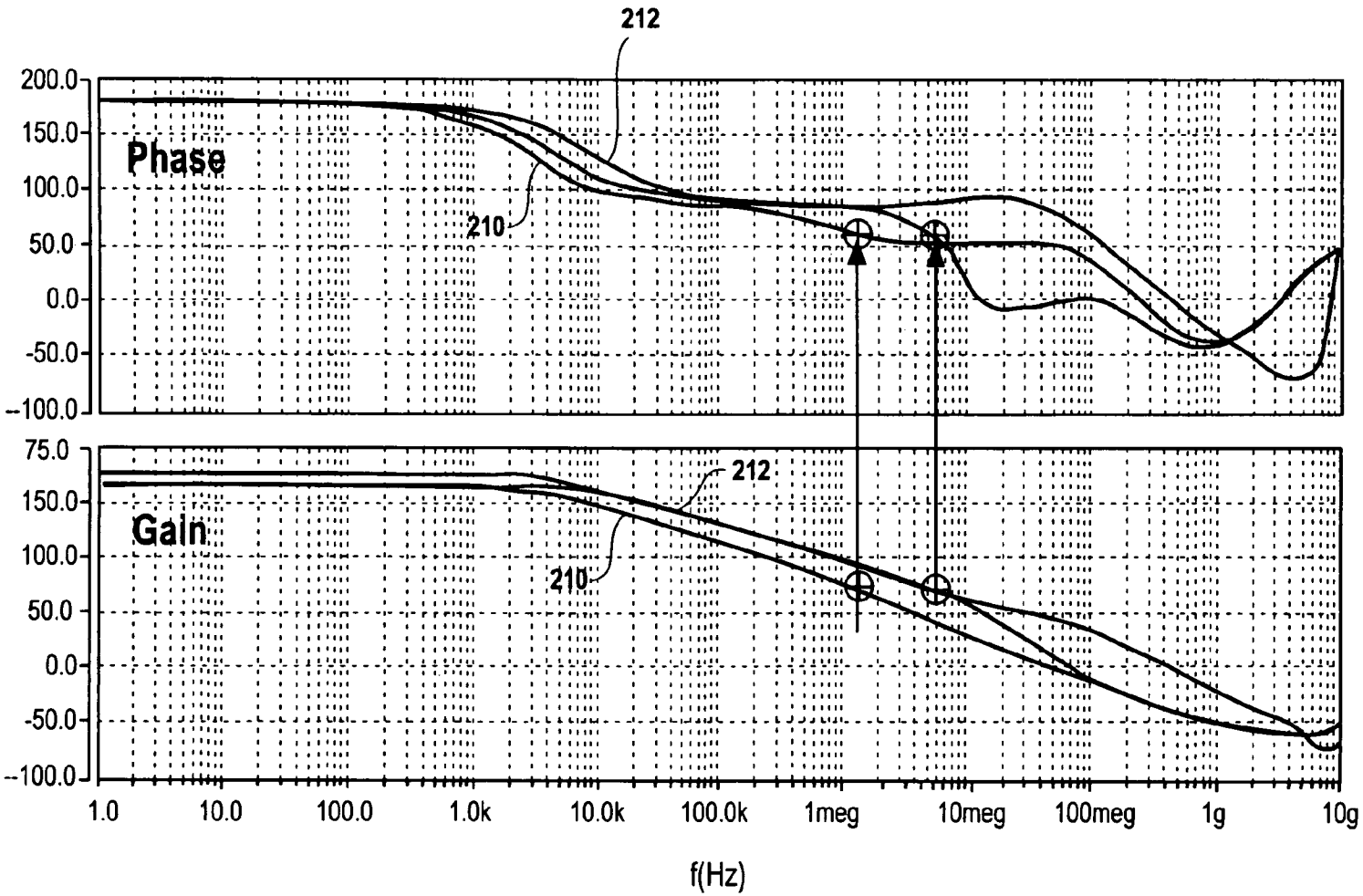
FIG. 4 illustrates an exemplary simulation of the loop gain frequency response at different capacitance and current loads in accordance with one embodiment of the present invention.

FIG. 4 illustrates an exemplary simulation of the loop gain frequency response at different capacitance and current loads in accordance with one embodiment of the present invention. The goal of frequency compensation is to separate all poles or zeros from the dominant output pole by 3 decades. In order to achieve this, designers work to move the dominant pole to low frequency.

Each pole reduces the gain by 20 dB per decade, in other words the gain drops from 60 dB down to 0 dB in 3 decades. If the output dominant pole is moved to 1 kHz, the gain will be 0 dB at a frequency of 1 MHz. In addition, each pole phase change is a maximum of 90°, which means the phase margin decreases from 180° to 90°. It should be noted that phase margins above 60° will guarantee system stability.

The exemplary simulations assume the compensation capacitance of 10 pF, output load capacitances of 2 nF and 50 nF, output load current of 1 mA 100 mA. A DC loop gain of 60 dB and an op-amp open-loop gain of 40 dB are targeted for proper LDO voltage regulator operation. As illustrated by curve 210, the unconditional frequency compensation technique of the present invention has a simulated 0 dB frequency of about 1.4 MHz for an output load capacitance of 50 nF. For an output load capacitance of 2 nF, the unconditional frequency compensation of the present invention has a simulated 0 dB frequency of about 5.8 MHz, as illustrated by curve 212. By designing the LDO voltage regulator so that the output dominant pole is at a low frequency for the smallest output load capacitance, the LDO voltage regulator will have adequate frequency behavior over the expected variation in output load capacitance.

Figure 5:
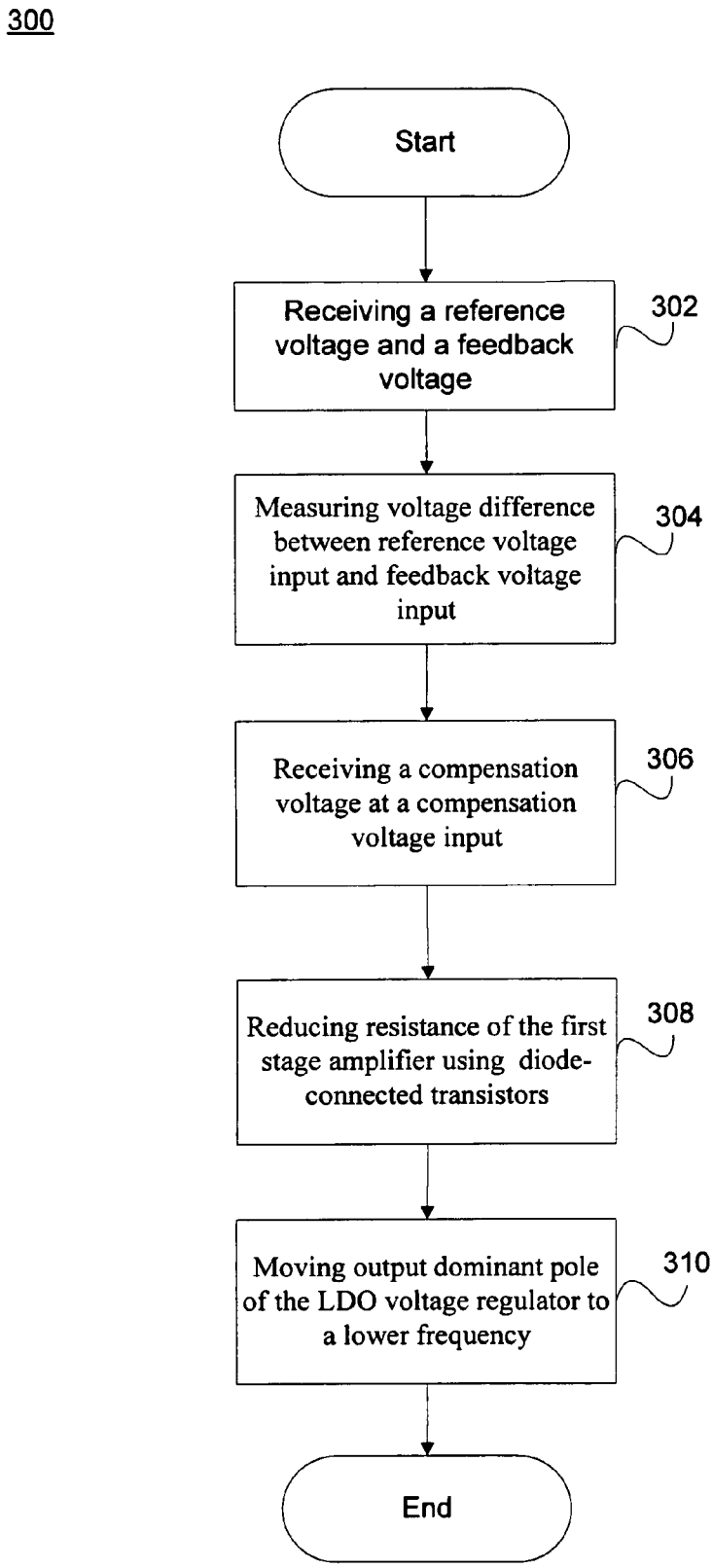
FIG. 5 is a flow chart diagram illustrating method operations for an unconditional frequency compensation method for a LDO voltage regulator in accordance with one embodiment of the present invention.

FIG. 5 is a flow chart diagram illustrating method operations for an unconditional frequency compensation method for a LDO voltage regulator in accordance with one embodiment of the present invention. The method 300 begins with operation 302, where the reference voltage input of a first stage amplifier receives a reference voltage and the feedback voltage input of a first stage amplifier receives a feedback voltage. In one embodiment, the feedback voltage is a voltage of a voltage divider connected to the output node of the LDO voltage regulator, as illustrated in FIG. 2. The method 300 advances to operation 304 where a voltage difference between the reference voltage input and the feedback voltage input is measured.

In operation 306, a compensation voltage at a compensation capacitance input, located between the first stage amplifier and the second stage amplifier, is received. In one embodiment, a current through the plurality of diode-connected transistors is adjusted based on the voltage at the compensation capacitance input. The method 300 then proceeds to operation 308 where the resistance of the first stage amplifier is reduced by use of a diode-connected transistor connected to each of a plurality of input transistors, as illustrated in FIG. 2. In operation 310, the output dominant pole of the LDO voltage regulator is moved to a lower frequency by coupling a compensation capacitor between the output node of the LDO voltage regulator and the compensation capacitance input, as illustrated in FIG. 2. In one embodiment, the gain of the first stage amplifier is increased using a transistor coupled in parallel to each of the diode-connected transistors of the first stage amplifier.

The method and apparatus described herein may be incorporated into any suitable circuit, including processors and programmable logic devices (PLDs). The PLDs can include programmable array logic (PAL), programmable logic array (PLA), field programmable logic array (FPLA), electrically programmable logic devices (EPLD), electrically erasable programmable logic device (EEPLD), logic cell array (LCA), field programmable gate array (FPGA), application specific standard product (ASSP), application specific integrated circuit (ASIC), just to name a few.

The programmable logic device described herein may be part of a data processing system that includes one or more of the following components; a processor; memory; I/O circuitry; and peripheral devices. The data processing system can be used in a wide variety of applications, such as computer networking, data networking, instrumentation, video processing, digital signal processing, or any suitable other application where the advantage of using programmable or re-programmable logic is desirable. The programmable logic device can be used to perform a variety of different logic functions. For example, the programmable logic device can be configured as a processor or controller that works in cooperation with a system processor. The programmable logic device may also be used as an arbiter for arbitrating access to a shared resource in the data processing system. In yet another example, the programmable logic device can be configured as an interface between a processor and one of the other components in the system. In one embodiment, the programmable logic device may be one of the PLDs owned by ALTERA CORPORATION.

Although the foregoing invention has been described in some detail for purposes of clarity of understanding, it will be apparent that certain changes and modifications can be practiced within the scope of the appended claims. Accordingly, the present embodiments are to be considered as illustrative and not restrictive, and the invention is not limited to the details given herein, but may be modified within the scope and equivalents of the appended claims.

What is claimed is:

1. A low dropout (LDO) voltage regulator with unconditional frequency compensation comprising:

an operational amplifier having two-stages, the operational amplifier comprising a first stage amplifier and a second stage amplifier receiving output from the first stage amplifier, the first stage amplifier comprising:

a first input transistors a second input transistors a first diode-connected transistor coupled to the first input transistor, wherein a drain of the first input transistor coupled to the first diode-connected transistors;

a second diode-connected transistor coupled to the second input transistor, wherein a drain of the second input transistor coupled to the second diode-connected transistors and a first transistor connected in parallel to the first diode-connected transistor and a second transistor connected in parallel to the second diode-connected transistor, wherein the first and second transistors increase a gain of the first stage amplifier; and a compensation capacitance input between the first stage amplifier and the second stage amplifier, wherein a compensation voltage on the compensation capacitance input adjusts a current through the first diode-connected transistor coupled to the first input transistor and a gain of the first stage amplifier, wherein the compensation voltage comprises an output voltage at an output node of the LDO voltage regulator.

2. The LDO voltage regulator of claim 1, further comprising:

a compensation capacitor between the compensation capacitance input of the operational amplifier and the output node of the LDO voltage regulator.

3. The first stage amplifier of the LDO voltage regulator of claim 1, further comprising:

a feedback voltage input to the first input transistor of the first stage amplifier, and a reference voltage input to the second input transistor of the first stage amplifier.

4. The LDO voltage regulator of claim 1, wherein a voltage divider consists of a plurality of resistors in series.

5. The LDO voltage regulator of claim 1, wherein the LDO voltage regulator is included with an input/output circuitry of an integrated circuit.

6. The LDO voltage regulator of claim 2, wherein a location of an output dominant pole is determined by an output conductance of a plurality of PMOS pass gates and a compensation capacitor capacitance, and a location of a zero is determined by a resistance of the first and second diode connected transistors of the first stage amplifier and the compensation capacitor capacitance.

7. A low dropout (LDO) voltage regulator with an operational amplifier having two-stages, comprising:

a first stage amplifier having a plurality of input transistors, a feedback voltage input to a first input transistor, a reference voltage input to a second input transistor of the first stage amplifier, a first diode-connected transistor coupled to a drain of the first input transistor, a second diode-connected transistor coupled to a drain of the second input transistor, a first transistor coupled in parallel to the first diode-connected transistor, and a second transistor coupled in parallel to the second diode-connected transistor, wherein the first and second transistors increase a gain of the first stage amplifier;

a second stage amplifier receiving input from the first stage amplifier; and a compensation capacitor coupled between a compensation capacitance input of the operational amplifier and an output node of the LDO voltage regulator, wherein the compensation capacitance input is located between the first stage amplifier and the second stage amplifier, and wherein a compensation voltage on the compensation capacitance input adjusts a current through the first diode-connected transistor coupled to the first input transistor, wherein the compensation voltage comprises an output voltage at the output node of the LDO voltage regulator.

8. The LDO voltage regulator of claim 7, further comprising:

a voltage divider located at an output node coupled to the plurality of PMOS pass-gates, wherein the voltage divider provides voltage to the feedback input of the first stage amplifier.

9. The LDO voltage regulator of claim 7, wherein a gain of the second stage amplifier is higher than a gain of the first stage amplifier.

10. The LDO voltage regulator of claim 7, wherein the second stage amplifier is a current mirror.

11. The LDO voltage regulator of claim 7, further comprises:

a unity gain buffer coupled between an output of the second stage amplifier and the output node of the LDO voltage regulator.

12. The LDO voltage regulator of claim 7, wherein a location of a zero is determined by a resistance of the first and second diode-connected transistors of the first stage amplifier and a capacitance of the compensation capacitor.

13. The LDO voltage regulator of claim 7, further comprising:

a plurality of PMOS pass gates connected to an output load, the plurality of PMOS pass gates receiving voltage from the operational amplifier, and the plurality of PMOS pass gates providing current to the output load, wherein a location of an output dominant pole is determined by an output conductance of the plurality of PMOS pass gates and a capacitance of the compensation capacitor.

14. An unconditional compensation method for a low dropout (LDO) voltage regulator comprising:

receiving a reference voltage at a reference voltage input of a first stage amplifier and a feedback voltage at a feedback voltage input of a first stage amplifier;

measuring a voltage difference between the reference voltage input and the feedback voltage input;

receiving a compensation voltage at a compensation capacitance input located between the first stage amplifier and the second stage amplifier;

reducing a resistance of the first stage amplifier by use of a first diode-connected transistor coupled to a drain of a first input transistor of the first stage amplifier and a second diode-connected transistor coupled to a drain of a second input transistor of the first stage amplifier;

adjusting a current of the first diode-connected transistor based on the compensation voltage at a compensation capacitance input, wherein the compensation voltage comprises an output voltage at an output node of the LDO voltage regulator; and increasing a gain of the first stage amplifier by coupling a first transistor in parallel to the first diode-connected transistor and a second transistor in parallel to the second diode-connected transistor.

15. The compensation method of claim 14, further comprising moving a location of a zero of the LDO voltage regulator to higher frequency when coupling the first input transistor to the first diode-connected transistor and the second input transistor to the second diode-connected transistor, thereby reducing a gain of the first stage amplifier.

16. The compensation method of claim 14, further comprising:

adjusting an output voltage to a plurality of PMOS pass gates based on the measured voltage difference between the reference voltage at a reference voltage input of a first stage amplifier and the feedback voltage at a feedback voltage input of a first stage amplifier.

17. The compensation method of claim 14, wherein the gate of the first transistor is parallel to the first diode-connected transistor and the gate of the second transistor is parallel to the second diode-connected transistor.

18. The compensation method of claim 14, further comprising:

dividing a voltage at the output node using the voltage divider consisting of a plurality of resistors, the voltage providing feedback to the feedback input of the first stage amplifier.

19. The compensation method of claim 14, further comprising:

moving an output dominant pole of the LDO voltage regulator to a lower frequency by coupling a compensation capacitor between the output node of the LDO voltage regulator and the compensation capacitance input.

* * * * *